US009004947B2

(12) United States Patent
Tanaka et al.

(10) Patent No.: US 9,004,947 B2
(45) Date of Patent: Apr. 14, 2015

(54) SHIELD CONNECTOR DEVICE

(71) Applicant: Yazaki Corporation, Minato-ku, Tokyo (JP)

(72) Inventors: Masahiro Tanaka, Kakegawa (JP); Hajime Kato, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/357,787

(22) PCT Filed: Dec. 26, 2012

(86) PCT No.: PCT/JP2012/084284
§ 371 (c)(1),
(2) Date: May 13, 2014

(87) PCT Pub. No.: WO2013/100181
PCT Pub. Date: Jul. 4, 2013

(65) Prior Publication Data

US 2014/0329410 A1 Nov. 6, 2014

(30) Foreign Application Priority Data

Dec. 28, 2011 (JP) ..... 2011-288960

(51) Int. Cl.
*H01R 13/648* (2006.01)
*H01R 13/52* (2006.01)
(Continued)

(52) U.S. Cl.
CPC ..... *H01R 13/648* (2013.01); *H01R 9/032* (2013.01); *H01R 12/59* (2013.01);
(Continued)

(58) Field of Classification Search
CPC ..... H01R 13/6581; H01R 13/6591; H01R 13/6593; H01R 13/648
See application file for complete search history.

(56) References Cited

U.S. PATENT DOCUMENTS 4,708,663 A * 11/1987 Eckart ..... 439/469
5,183,417 A * 2/1993 Bools ..... 439/607.5
(Continued)

FOREIGN PATENT DOCUMENTS

JP 2003-197037 A 7/2003
JP 2004-171952 A 6/2004
(Continued)

OTHER PUBLICATIONS

International Search Report (PCT/ISA/210) dated Mar. 25, 2013 issued by the International Searching Authority, in International Application No. PCT/JP2012/084284.
(Continued)

*Primary Examiner* — James Harvey
(74) *Attorney, Agent, or Firm* — Sughrue Mion, PLLC

(57) ABSTRACT

A shield connector is provided capable of reducing the number of components and assembly processes while ensuring shielding characteristics and movability. First and second connectors 10 and 20 respectively including terminals 16 and 26, connector housings 11 and 21 having operation opening portions 12 and 22 for connecting the terminals, and service covers 13 and 23 covering the opening portions, electric wires 40 connecting both the connectors, and a shield shell 50 shielding both the connectors and the electric wires are included. The shield shell is divided into a first shield shell 51 fixed to the first connector and second shield shells 52 and 53 fixed to the second connector, and the peripheral edges of the shield shells overlap each other while enabling relative movement between the first shield shell and the second shield shell. The service cover of the first connector has an interlocking portion 15.

3 Claims, 8 Drawing Sheets

(51) Int. Cl.

| | |
|---|---|
| ***H01R 13/641*** | (2006.01) |
| ***H01R 13/6593*** | (2011.01) |
| *H01R 9/03* | (2006.01) |
| *H01R 12/59* | (2011.01) |
| *H01R 13/53* | (2006.01) |

(52) U.S. Cl.

CPC ..... *H01R 13/5213* (2013.01); *H01R 13/53* (2013.01); *H01R 13/641* (2013.01); *H01R 13/6593* (2013.01); *H01R 2201/26* (2013.01)

(56) References Cited

U.S. PATENT DOCUMENTS

| | | | | |
|---|---|---|---|---|
| 7,074,057 | B2 * | 7/2006 | Chiran et al. | 439/92 |
| 7,695,320 | B2 * | 4/2010 | Tsukashima et al. | 439/607.44 |
| 2003/0119351 | A1 | 6/2003 | Miyazaki et al. | |
| 2004/0065472 | A1 * | 4/2004 | Sekijima et al. | 174/250 |
| 2004/0099427 | A1 | 5/2004 | Kihira | |
| 2007/0207652 | A1 * | 9/2007 | Tsuruta | 439/166 |
| 2013/0065405 | A1 * | 3/2013 | Tsuchiya et al. | 439/34 |
| 2014/0030921 | A1 * | 1/2014 | Kobayashi et al. | 439/607.01 |
| 2014/0051282 | A1 * | 2/2014 | Tanaka et al. | 439/502 |
| 2014/0113489 | A1 * | 4/2014 | Tanaka et al. | 439/607.53 |
| 2014/0248800 | A1 * | 9/2014 | Tanaka et al. | 439/607.01 |
| 2014/0329410 | A1 * | 11/2014 | Tanaka et al. | 439/607.41 |
| 2014/0334110 | A1 * | 11/2014 | Nichols et al. | 361/729 |

FOREIGN PATENT DOCUMENTS

| | | | |
|---|---|---|---|
| JP | 2010-282924 | A | 12/2010 |
| JP | 2011-124062 | A | 6/2011 |

OTHER PUBLICATIONS

Written Opinion (PCT/ISA/237) dated Mar. 25, 2013 issued by the International Searching Authority, in International Application No. PCT/JP2012/084284.

* cited by examiner

SHIELD CONNECTOR DEVICE

TECHNICAL FIELD

The present invention relates to a shield connector device in which connectors are mounted to both ends of electric wires for connection between two devices and are then shielded.

BACKGROUND ART

In a shield connector device 101 according to the related art illustrated in FIGS. 7 and 8, to both ends of electric wires 130 having flexibility, shield connectors 110 and 120 which respectively include terminals 116 and 126 connected to the conductors of the electric wires 130, connector housings 111 and 121 made of an insulating material to accommodate the terminals 116 and 126, and shield shells 112 and 122 that cover the outer sides of the connector housings 111 and 121 are mounted. In addition, braids 140 are provided as a shield cover so as to cover the outer sides of the electric wires 130 exposed between the shield connectors 110 and 120 at both ends, and both ends of the braids 140 are fixed to the cylindrical portions of the respective shield shells 112 and 122 of the shield connectors 110 and 120 by crimping shield rings 150. The braids 140 are used to ensure slight movability between the shield connectors 110 and 120 at both ends.

Examples of such a type of shield connector device are disclosed in, for example, Patent Documents 1 and 2.

In addition, a configuration in which electric wires are covered with a shield pipe instead of covering the electric wires between two shield connectors with braids is disclosed in, for example, Patent Document 3.

CITATION LIST

Patent Literature

[PTL 1] Japanese Patent Publication No. JP-A-2010-282924

[PTL 2] Japanese Patent Publication No. JP-A-2003-197037

[PTL 3] Japanese Patent Publication No. JP-A-2004-171952

[PTL 4] Japanese Patent Publication No. JP-A-2011-124062

SUMMARY OF INVENTION

Technical Problem

In the shield connector device 101 according to the related art described above, in a case where the braids 140 impact with other components due to vibration or the like of a device or a vehicle, there is a concern that the braids 140 which are weaker in strength than the shield shells 112 and 122 made of metal plates and the like may be damaged.

On the other hand, in Patent Document 4, a configuration in which a shield connector is provided with an interlocking portion is disclosed. In the shield connector described in Patent Document 4, even in a case where a cover shifts accidentally, current is blocked by the interlocking portion. However, in the configuration of FIGS. 7 and 8, in a case where the configuration of the interlocking portion of Patent Document 4 is applied in order to safely detach the cover of each of the two shield connectors, it is necessary to provide the interlocking portion to each of the two shield connectors.

The present invention has been made taking the foregoing circumstances into consideration, and an object thereof is to provide a shield connector device in which there is no concern of damage even in a case where a shield member that covers the outer side of electric wires impacts with other components due to vibration or the like, while ensuring shielding characteristics and movability between connectors at both ends and not both of a pair of shield connectors needs an interlocking portion.

In order to achieve the object described above, a shield connector device according to the invention are characterized by the following (1) and (2).

(1) A shield connector device comprising:

first and second connectors, each of which includes a terminal connected to a terminal of a mating connector, a connector housing made of an insulating material, which accommodates the terminal and is provided with an operation opening portion for connecting the terminal to the terminal of the mating connector, and a service cover made of an insulating material, which is mounted to the connector housing to block the opening portion after a connection operation of the terminal;

an electric wire, both ends of a conductor of which are respectively connected to the terminals of the first and second connectors; and a shield shell made of a metal plate, which shields the first and second connectors and the electric wire, wherein the shield shell is divided into two sections including a first shield shell fixed to the first connector and a second shield shell fixed to the second connector, wherein peripheral edges of the first and second shield shells along a dividing line overlap each other in a state of enabling relative movement between the first shield shell and the second shield shell, wherein the service cover of the first connector is further provided with an interlocking portion which allows electrical connection to the terminal of the first connector when the service cover of the first connector is mounted to the connector housing of the first connector after the terminal of the first connector is connected to the terminal of the mating connector, and blocks electrical connection to the terminal of the first connector when the service cover of the first connector is detached from the connector housing of the first connector, wherein at least a part of the first shield shell is configured to be joined to the service cover of the first connector and thus to be attached to and detached from the connector housing of the first connector concurrently with attachment and detachment of the service cover, wherein at least a part of the second shield shell is configured to be joined to the service cover of the second connector and thus to be attached to and detached from the connector housing of the second connector concurrently with attachment and detachment of the service cover, and wherein a peripheral edge of the at least a part of the first shield shell joined to the service cover of the first connector overlaps an outer side of a peripheral edge of the at least a part of the second shield shell joined to the service cover of the second connector.

(2) The shield connector device according to the above (1), wherein at least a part of the first shield shell is configured to be joined to the service cover of the first connector and thus to be attached to and detached from the connector housing of the first connector concurrently with the attachment and the detachment of the service cover, and is formed with such a size that covers the service cover of the second connector when the first shield shell being mounted to the connector housing.

According to the shield connector device of the configuration of (1), the connectors at both ends and the electric wire that connects connectors at both ends to each other may be reliably shielded by the shield shell.

In addition, although the first shield shell fixed to the first connector and the second shield shell fixed to the second connector are divided from each other, the peripheral edges along the dividing line overlap each other. Therefore, shielding characteristics may be ensured without gaps, thereby eliminating shield leakage spots.

In addition, the first shield shell and the second shield shell are not joined to each other but freely move to some extent relative to each other.

Therefore, movability between the connectors at both ends may be ensured to a necessary extent, and thus there is no inconvenience relating to the slight movement needed to connect the connectors to the mating connectors.

In addition, since the shield shell may be made of a metal plate, there is no concern of damage even in a collision with other components due to vibration or the like of a device or a vehicle.

In addition, since the connector housings of the connectors are respectively provided with the operation opening portions for connecting the terminals to the terminals of the mating connectors, the terminals may be firmly connected to the terminals of the mating connectors through the opening portions, and thus electrical connection performance sufficient to be used for connection to a high-voltage circuit may be realized. In addition, the operation opening portions formed in the connector housings may be blocked later by the service covers and then may be covered with the shield shell. Therefore, although the connector housings are provided with the opening portions, reliable sealing characteristics and shielding characteristics may be maintained.

In addition, since the service cover of the first connector is provided with the interlocking portion, electrical connection to the terminal may be blocked by causing a state in which the service cover of the first connector is detached. Therefore, even in a case of connection to a high-voltage circuit, the connection operation of the terminal may be safely performed.

In addition, since the service cover of the first connector and the service cover of the second connector are respectively joined to at least a part of the first shield shell and at least a part of the second shield shell, a part including the service cover may be covered with the shield shell by mounting the service cover to the connector housing.

At this time, the peripheral edges of both the shield shells are caused to overlap each other so that the first shield shell joined to the service cover of the first connector having the interlocking portion is closer to the outer side than the second shield shell joined to the service cover of the second connector. Therefore, as long as the service cover on the first connector side provided with the interlocking portion is not detached, the service cover of the second connector is not detached by the interruption of the first shield shell. That is, the service cover of the second connector may be detached only when the service cover of the first connector is detached. Therefore, by only providing the interlocking portion to the first connector, the service cover of the second connector may be safely detached.

According to the shield connector device of the configuration of (2), at least a part of the first shield shell is joined to the service cover of the first connector and the first shield shell joined to the service cover is formed with such a size that covers the service cover of the second connector during mounting to the connector housing of the service cover. Therefore, by mounting the service cover of the first connector to the connector housing, not only a part including the corresponding service cover but also the service cover of the second connector may be concurrently covered with the shield shell.

At this time, since the service cover of the second connector is covered with the first shield shell joined to the service cover of the first connector having the interlocking portion, the service cover of the second connector is not detached by the interruption of the first shield shell as long as the service cover on the first connector side provided with the interlocking portion is not detached.

In this case, in the shield connector device of the configuration of (1), since the second shield shell joined to the service cover of the second connector is movable with respect to the first shield shell, there is a possibility that the overlapping of both the shield shells may shift due to excessive movement and the service cover of the second connector may be detached even though the service cover of the first connector is not detached. However, in the case of the shield connector device of the configuration of (2), since the service cover of the second connector is covered with the first shield shell joined to the service cover of the first connector, the service cover of the second connector may not be detached more reliably as long as the service cover of the first connector is not detached. Therefore, exposure of the terminals due to the service cover of the second connector shifting for some reason may be more reliably prevented, thereby enhancing safety.

Advantageous Effects of Invention

According to the present invention, by using first and second shield shells instead of braids, the connectors at both ends and an electric wire that connects the connectors may be reliably shielded.

In addition, since the first shield shell and the second shield shell may freely move to some extent relative to each other, movability between the connectors at both ends may be ensured to a necessary extent.

In addition, since the shield shell may be made of a metal plate, there is no concern of damage even in a collision with other components due to vibration or the like of a device or a vehicle.

In addition, since the connector housings of the connectors are respectively provided with the operation opening portions for connecting the terminals to the terminals of the mating connectors, the terminals may be firmly connected to the terminals of the mating connectors through the opening portions, and thus electrical connection performance sufficient to be used for connection to a high-voltage circuit may be realized. In addition, the operation opening portions formed in the connector housings may be blocked later by the service covers and then may be covered with the shield shell. Therefore, although the connector housings are provided with the opening portions, reliable sealing characteristics and shielding characteristics may be maintained.

In addition, since the service cover of the first connector is provided with the interlocking portion, electrical connection to the terminal may be blocked by causing a state in which the service cover of the first connector is detached. Therefore, even in a case of connection to a high-voltage circuit, the connection operation of the terminal may be safely performed. In addition, since the service cover of the first connector is provided with the interlocking portion, as long as the service cover on the first connector side provided with the interlocking portion is not detached, the service cover of the second connector is not detached by the interruption of the first shield shell. That is, the service cover of the second connector may be detached only when the service cover of the first connector is detached. Therefore, by only providing the interlocking portion to the first connector, the service cover of the second connector may be safely detached.

DESCRIPTION OF EMBODIMENTS

Hereinafter, embodiments of the present invention will be described with reference to the drawings.

Figure 1:
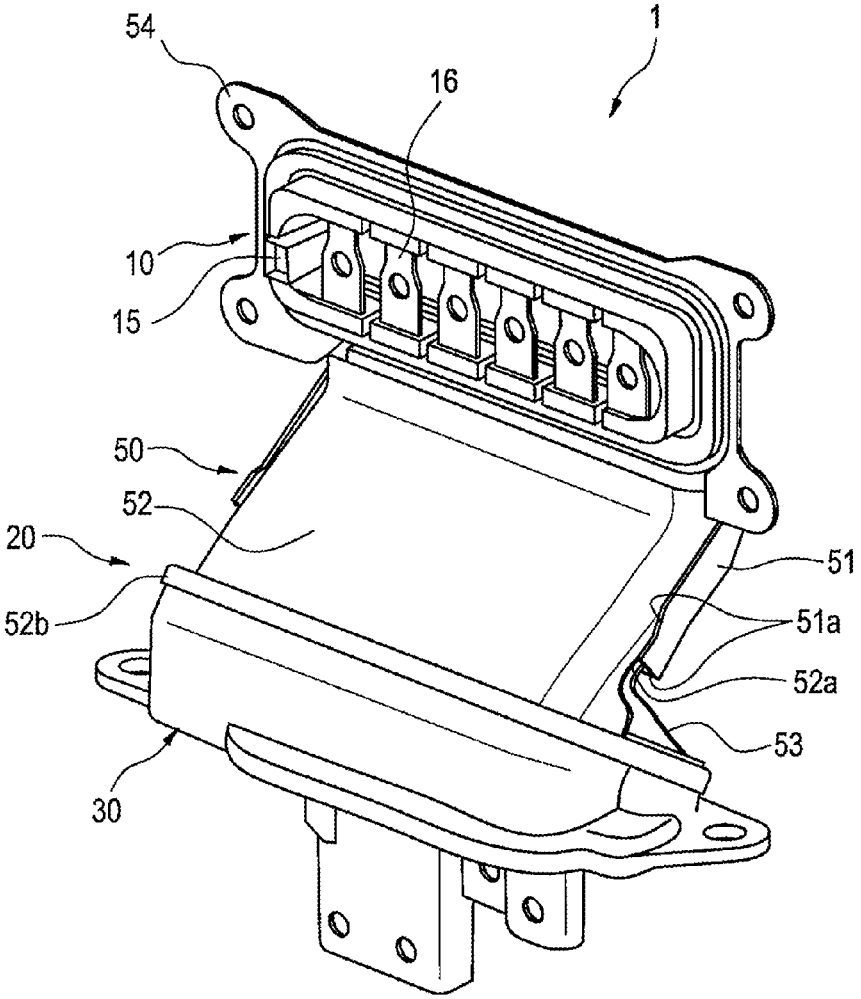
FIG. 1 is a perspective view of the external form of a shield connector device of a first embodiment of the present invention.
Figure 2:
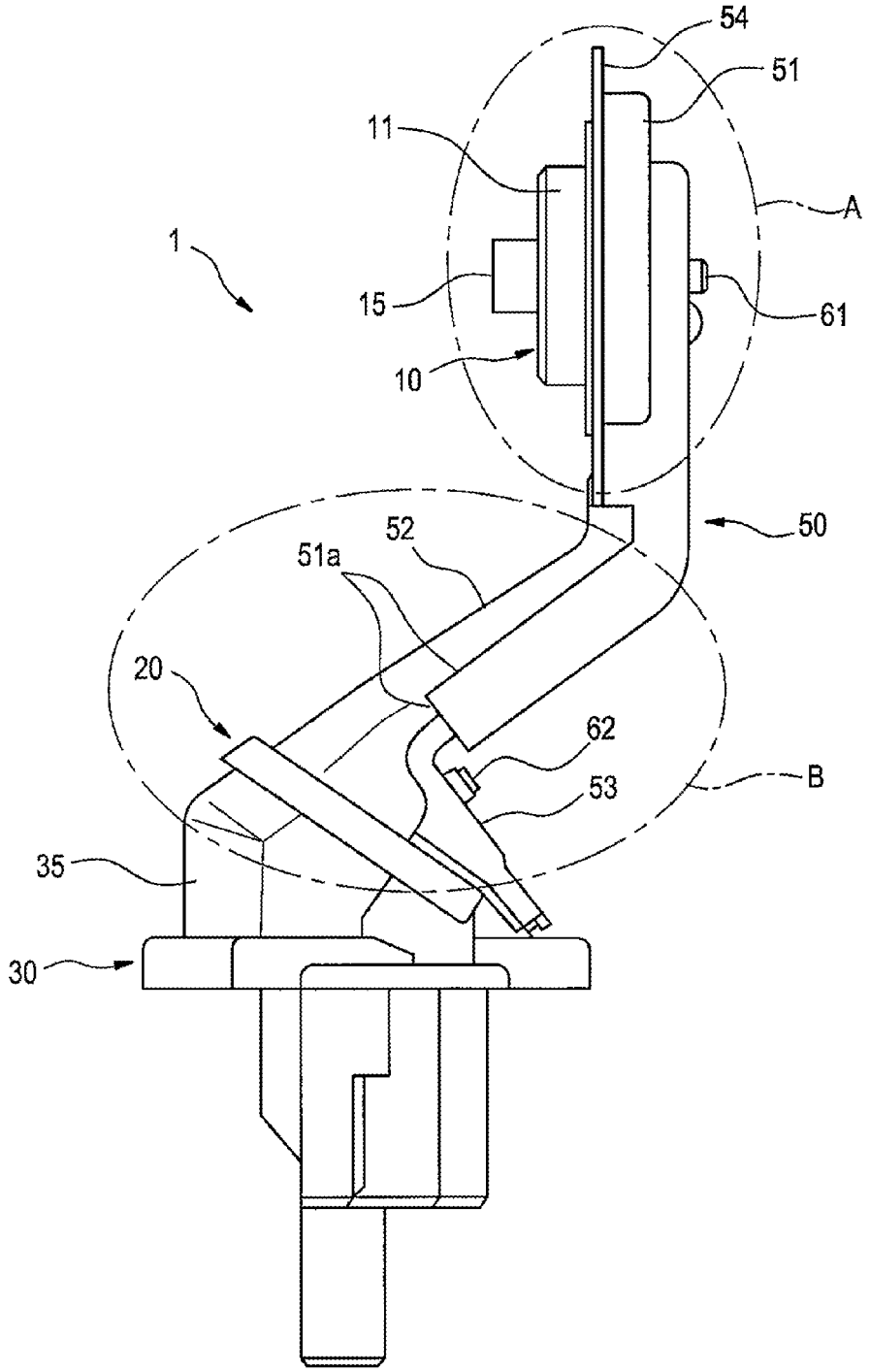
FIG. 2 is a side view of the shield connector device.
Figure 3A:
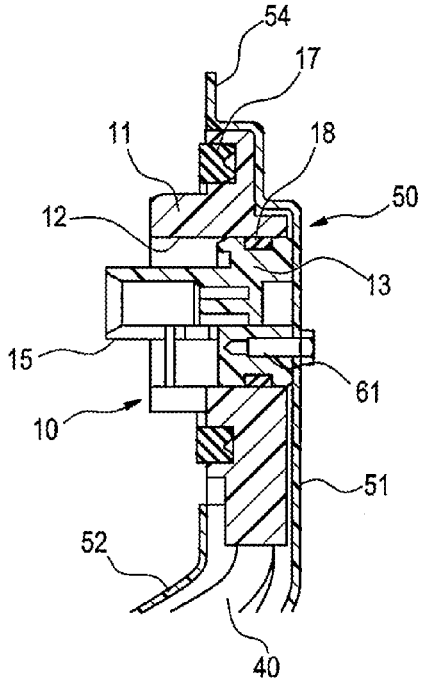
FIG. 3A is a cross-sectional view of the vicinity of an upper connector which is part A of FIG. 2.
Figure 3B:
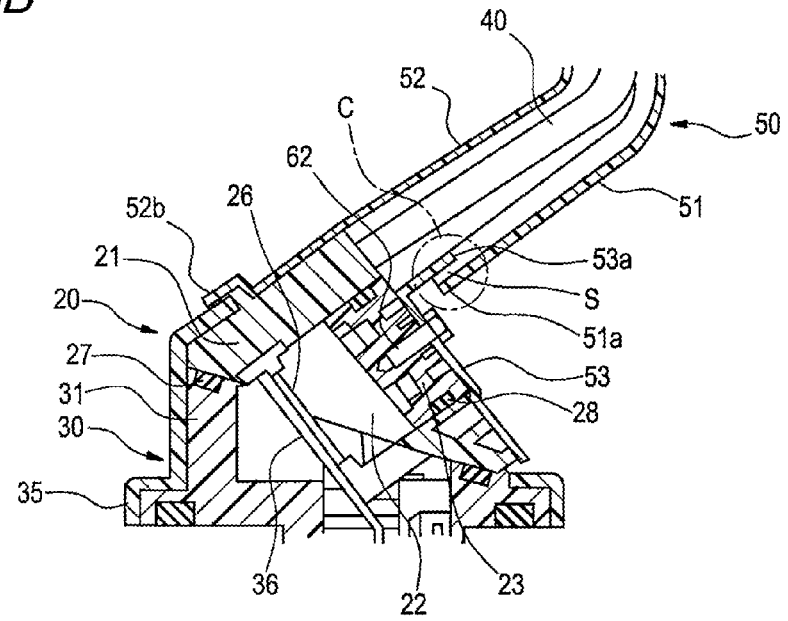
FIG. 3B is a cross-sectional view of the vicinity of a lower connector which is part B of FIG. 2.

FIG. 1 is a perspective view of the external form of a shield connector device of a first embodiment. FIG. 2 is a side view of the shield connector device. FIG. 3A is a cross-sectional view of the vicinity of an upper connector which is part A of FIG. 2. FIG. 3B is a cross-sectional view of the vicinity of a lower connector which is part B of FIG. 2.

A shield connector device 1 of the first embodiment includes a first connector 10 which is on the upper side in the figure, a second connector 20 which is on the lower side in the figure, electric wires 40 (see FIGS. 3A and 3B) having flexibility, which connect the first connector 10 to the second connector 20, and a shield shell 50 made of a metal plate, which shields the first and second connectors 10 and 20 and the electric wires 40. In the figures, a state in which a connector (standby connector) 30 on a device side is connected to the second connector 20 on the lower side is illustrated.

The first connector 10 on the upper side includes, as illustrated in FIGS. 1 and 3A, a plurality of terminals (here, configured as busbars) 16 connected to the terminals of a mating connector, a connector housing 11 made of an insulating material, which accommodates the terminals 16 and is provided with an operation opening portion 12 for connecting the terminals 16 to the terminals of the mating connector, and a service cover 13 made of an insulating material, which is mounted to the connector housing 11 to block the opening portion 12 after the connection operation of the terminals 16.

In the front surface (a surface that comes into contact with the connector housing of the mating connector) of the connector housing 11, a seal member 17 that, during the connection to the mating connector, surrounds the electrical connection part by coming into close contact with the mating connector for sealing is provided. In addition, even in the outer periphery of the service cover 13, a seal member 18 which seals the gap from the connector housing 11 when the service cover 13 is fitted in the opening portion 12 is provided.

In addition, the service cover 13 of the first connector 10 is provided with an interlocking portion 15. The interlocking portion 15 is a part that achieves functions of allowing electrical connection from the mating connector to the terminals 16 of the first connector 10 when the service cover 13 is mounted to the connector housing 11 so as to block the opening portion 12 after the terminals 16 of the first connector 10 are connected to the terminals of the mating connector using the opening portion 12, and blocking electrical connection from the mating connector to the terminals 16 of the first connector 10 when the service cover 13 is detached from the connector housing 11. Therefore, the interlocking portion 15 has the similar constitution with that disclosed in the above mentioned prior art.

In addition, the second connector 20 on the lower side includes, as illustrated in FIG. 3B, a plurality of terminals (here, configured as busbars) 26 connected to the terminals (here, configured as busbars) 36 of the mating connector 30, a connector housing 21 made of an insulating material, which accommodates the terminals 26 and is provided with an operation opening portion 22 for connecting the terminals 26 to terminals 36 of the mating connector 30, and a service cover 23 made of an insulating material, which is mounted to the connector housing 21 to block the opening portion 22 after the connection operation of the terminals 26.

In the front surface (a surface that comes into contact with a connector housing 31 of the mating connector 30) of the connector housing 21, a seal member 27 that, during the connection to the mating connector 30, surrounds the electrical connection part by coming into close contact with the mating connector 30 for sealing is provided. In addition, even in the outer periphery of the service cover 23, a seal member 28 which seals the gap from the connector housing 21 when the service cover 23 is fitted in the opening portion 22 is provided.

In addition, the service cover 23 of the second connector 20 is not provided with an interlocking portion.

Regarding the electric wires 40 that connect the first connector 10 to the second connector 20, both ends of the conductors thereof are respectively connected to the terminals 16 and 26 of the first connector 10 and the second connector 20.

The shield shell 50 that shields the first connector 10, the second connector 20, and the electric wires 40 are divided into three sections including a single first shield shell 51 fixed to the first connector 10 and two second shield shells 52 and 53 fixed to the second connector 20. In addition, peripheral edges 51*a*, 52*a*, and 53*a* of the shield shells 51, 52, and 53 along the dividing lines overlap each other in a state of having a gap S (see part C of FIG. 3B) that enables relative movement between the first shield shell 51 and the second shield shells 52 and 53.

The first shield shell 51 is configured to be joined to the service cover 13 of the first connector 10 by a screw 61 and thus to be attached to and detached from the connector housing 11 of the first connector 10 concurrently with the attachment and detachment of the service cover 13 to and from the connector housing 11. The outer peripheral portion of a part that covers the connector housing 11 is provided with an earth terminal 54, and a part that covers the electric wires 40 is formed in a half cylinder shape having a small depth.

In addition, the shield shell 53 which is on the lower side and is smaller in the two second shield shells 52 and 53 is configured to be joined to the service cover 23 of the second connector 20 by a screw 62 and thus to be attached to and detached from the connector housing 21 of the second connector 20 concurrently with the attachment and detachment of the service cover 23 to and from the connector housing 21.

Both the two second shield shells 52 and 53 have parts that cover the connector housing 21 and parts that cover the electric wires 40, and the parts that cover the electric wires 40 are formed in a half cylinder shape having a small depth. Here, the one second shield shell 52 is disposed to cover the electric wires 40 from the opposite side to the first shield shell 51, and the other second shield shell 53 which is smaller is disposed to cover the electric wires 40 at a part that is not covered with the first shield shell 51 from the same side as that of the first shield shell 51. In addition, a peripheral edge 52*b* of the end portion of the one second shield shell 52 is configured to overlap the peripheral edge of the shield shell 35 of the mating connector 30.

Here, the important fact is that, as illustrated in part C of FIG. 3B, the peripheral edge 51*a* of the first shield shell 51 joined to the service cover 13 of the first connector 10 overlaps the outer side of the peripheral edge 53*a* of the second shield shell 53 joined to the service cover 23 of the second connector 20.

According to the shield connector device 1 configured as described above, the first and second connectors 10 and 20 at both ends and the electric wires 40 that connect the connectors 10 and 20 at both ends to each other may be reliably shielded by the shield shell 50.

In addition, although the first shield shell 51 fixed to the first connector 10 and the second shield shells 52 and 53 fixed to the second connector 20 are divided from each other, the peripheral edges 51*a*, 52*a*, and 53*a* along the dividing lines overlap each other. Therefore, shielding characteristics may be ensured without gaps, thereby eliminating shield leakage spots.

In addition, the first shield shell 51 and the second shield shells 52 and 53 are not joined to each other but freely move to some extent relative to each other. Therefore, movability between the connectors 10 and 20 at both ends may be ensured to a necessary extent, and thus there is no inconvenience relating to the slight movement needed to connect the connectors 10 and 20 to the mating connectors.

In addition, since the shield shell 50 may be made of a metal plate, there is no concern of damage even in a collision with other components due to vibration or the like of a device or a vehicle.

In addition, since the connector housings 11 and 21 of the connectors 10 and 20 are respectively provided with the operation opening portions 12 and 22 for connecting the terminals 16 and 26 to the terminals of the mating connectors, the terminals 16 and 26 may be firmly connected to the terminals of the mating connectors through the opening portions 12 and 22, and thus electrical connection performance sufficient to be used for connection to a high-voltage circuit may be realized. In addition, the operation opening portions 12 and 22 formed in the connector housings 11 and 21 may be blocked later by the service covers 13 and 23 and then may be covered with the first shield shell 51. Therefore, although the connector housings 11 and 21 are provided with the opening portions 12 and 22, reliable sealing characteristics and shielding characteristics may be maintained.

In addition, in the shield connector device 1 of this embodiment, since the service cover 13 of the first connector 10 is provided with the interlocking portion 15, electrical connection to the terminals 16 may be blocked by causing a state in which the service cover 13 of the first connector 10 is detached. Therefore, even in a case of connection to a high-voltage circuit, the connection operation of the terminals 16 may be safely performed.

In addition, since the first shield shell 51 and the second shield shell 52 are respectively joined to the service cover 13 of the first connector 10 and the service cover 23 of the second connector 20, parts including the service covers 13 and 23 may be covered with the shield shells 51 and 53 by mounting the service covers 13 and 23 to the connector housings 11 and 21.

At this time, as illustrated in part C of FIG. 3B, the peripheral edges 51*a* and 53*a* of both the shield shells 51 and 53 are caused to overlap each other so that the first shield shell 51 joined to the service cover 13 of the first connector 10 having the interlocking portion 15 is closer to the outer side than the second shield shell 53 joined to the service cover 23 of the second connector 20. Therefore, as long as the first shield shell 51 on the first connector 10 side provided with the interlocking portion 15 is not detached, the service cover 23 of the second connector 20 is not detached by the interruption of the first shield shell 51. That is, the service cover 23 of the second connector 20 may be detached only when the service cover 13 of the first connector 10 is detached. Therefore, by only providing the interlocking portion 15 to the first connector 10, the service cover 23 of the second connector 20 may be safely detached.

However, in the case of the shield connector device 1 of the first embodiment, since the second shield shell 53 joined to the service cover 23 of the second connector 20 is movable with respect to the first shield shell 51, there is a possibility that the overlapping of both the shield shells 51 and 53 may shift due to excessive movement and the service cover 23 of the second connector 20 may be detached even though the service cover 13 of the first connector 10 is not detached.

Here, a shield connector device of a second embodiment described as follows excludes such a possibility as much as possible.

Figure 4:
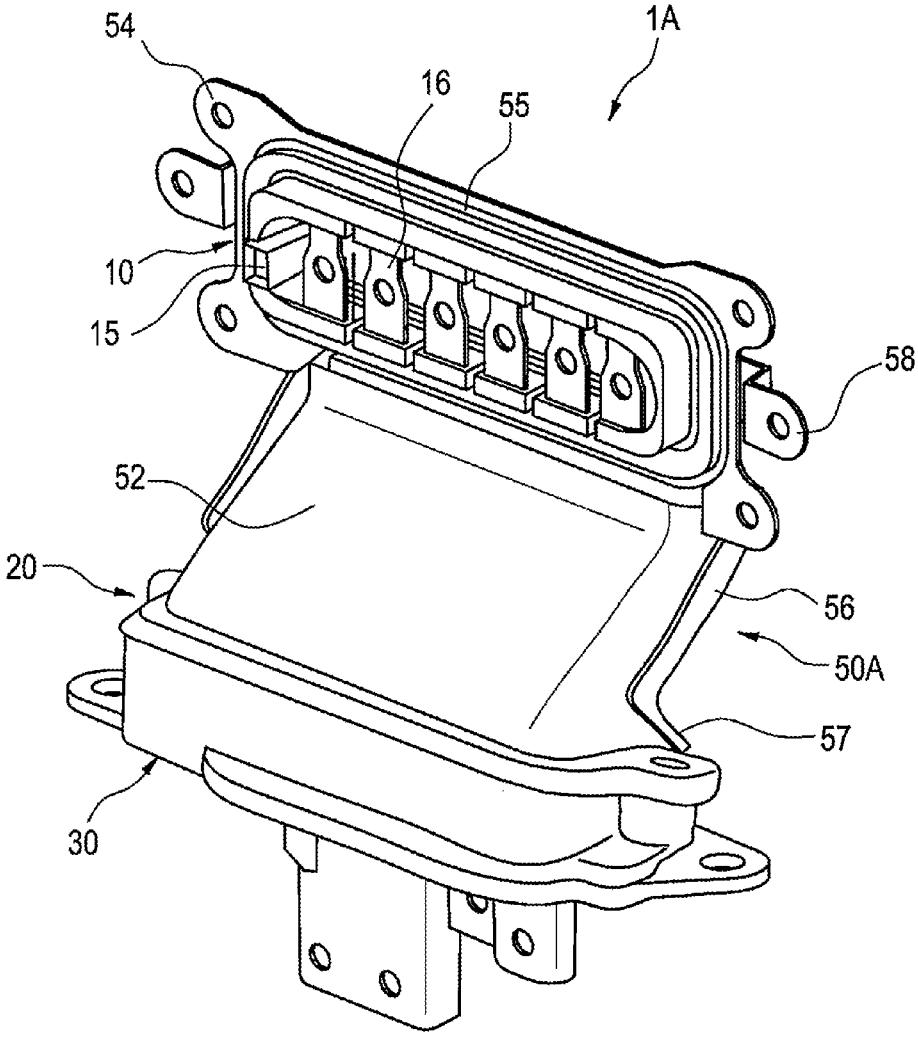
FIG. 4 is a perspective view of the external form of a shield connector device of a second embodiment of the present invention.
Figure 5:
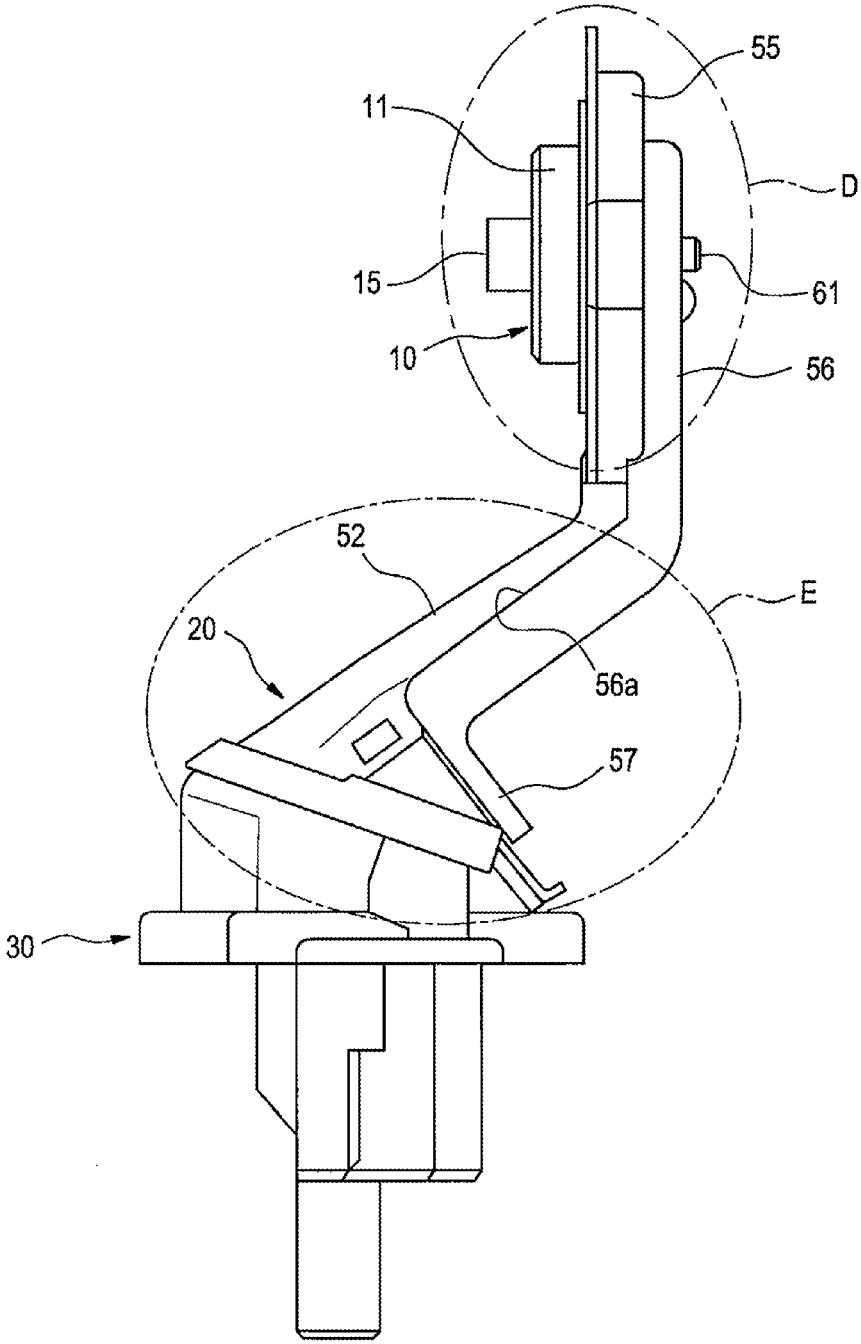
FIG. 5 is a side view of the shield connector device.
Figure 6A:
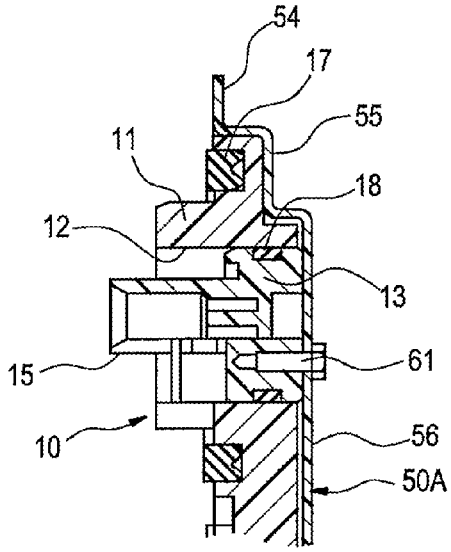
FIG. 6A is a cross-sectional view of the vicinity of an upper connector which is part D of FIG. 5.
Figure 6B:
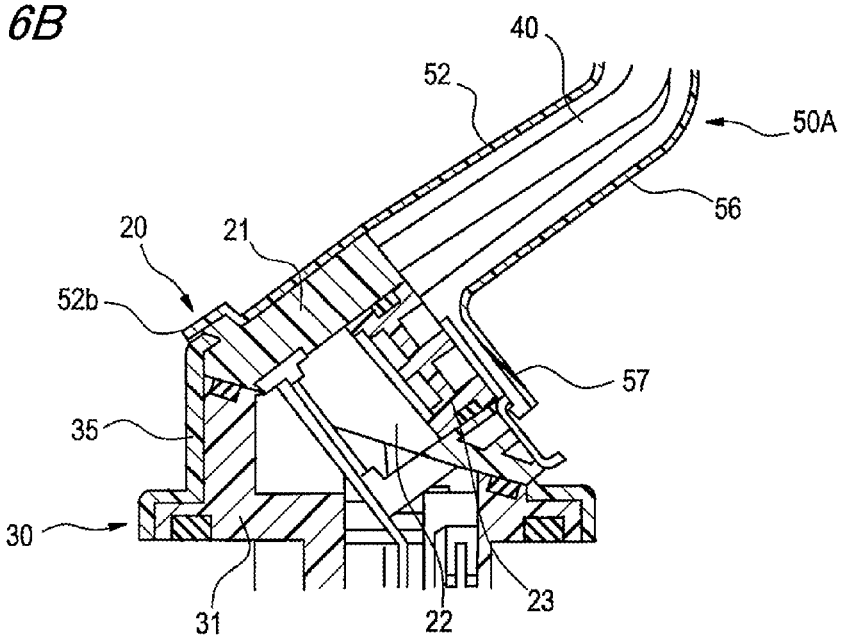
FIG. 6B is a cross-sectional view of the vicinity of a lower connector which is part E of FIG. 5.
Figure 7:
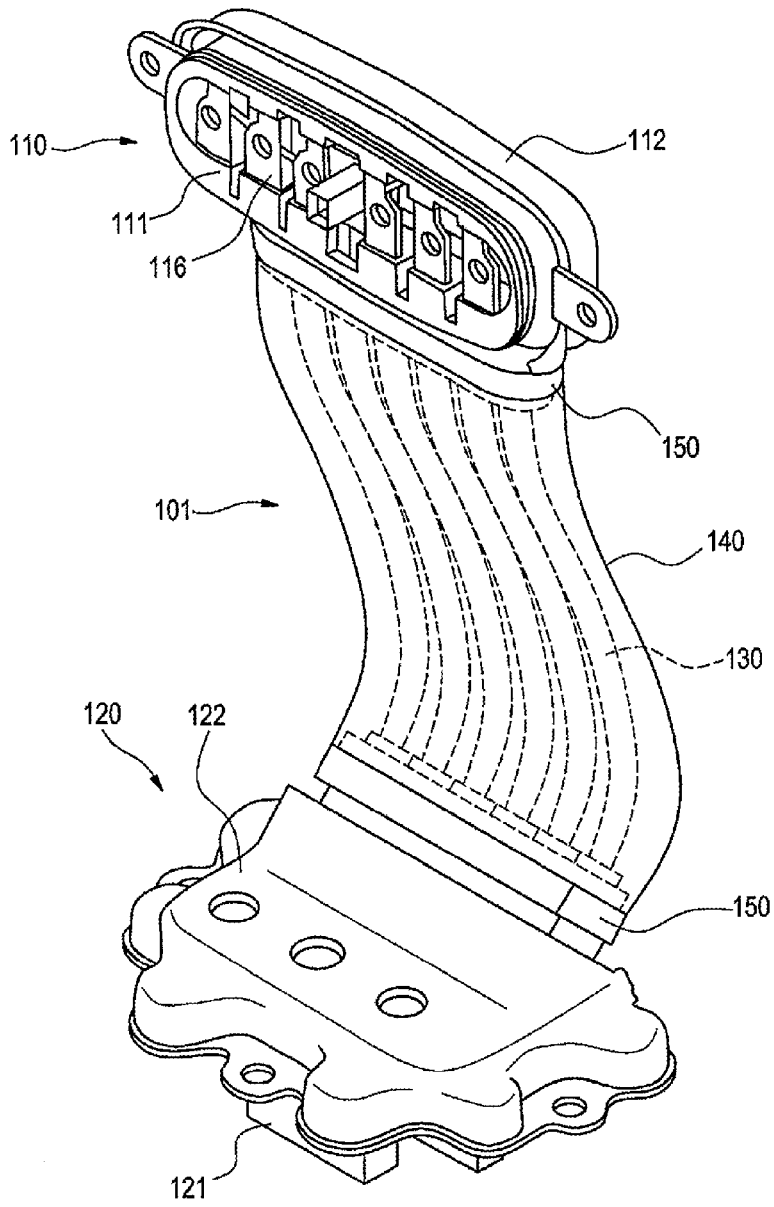
FIG. 7 PRIOR ART
FIG. 7 is a perspective view of the external form of electric wires to which shield connectors are attached according to the related art.
Figure 8:
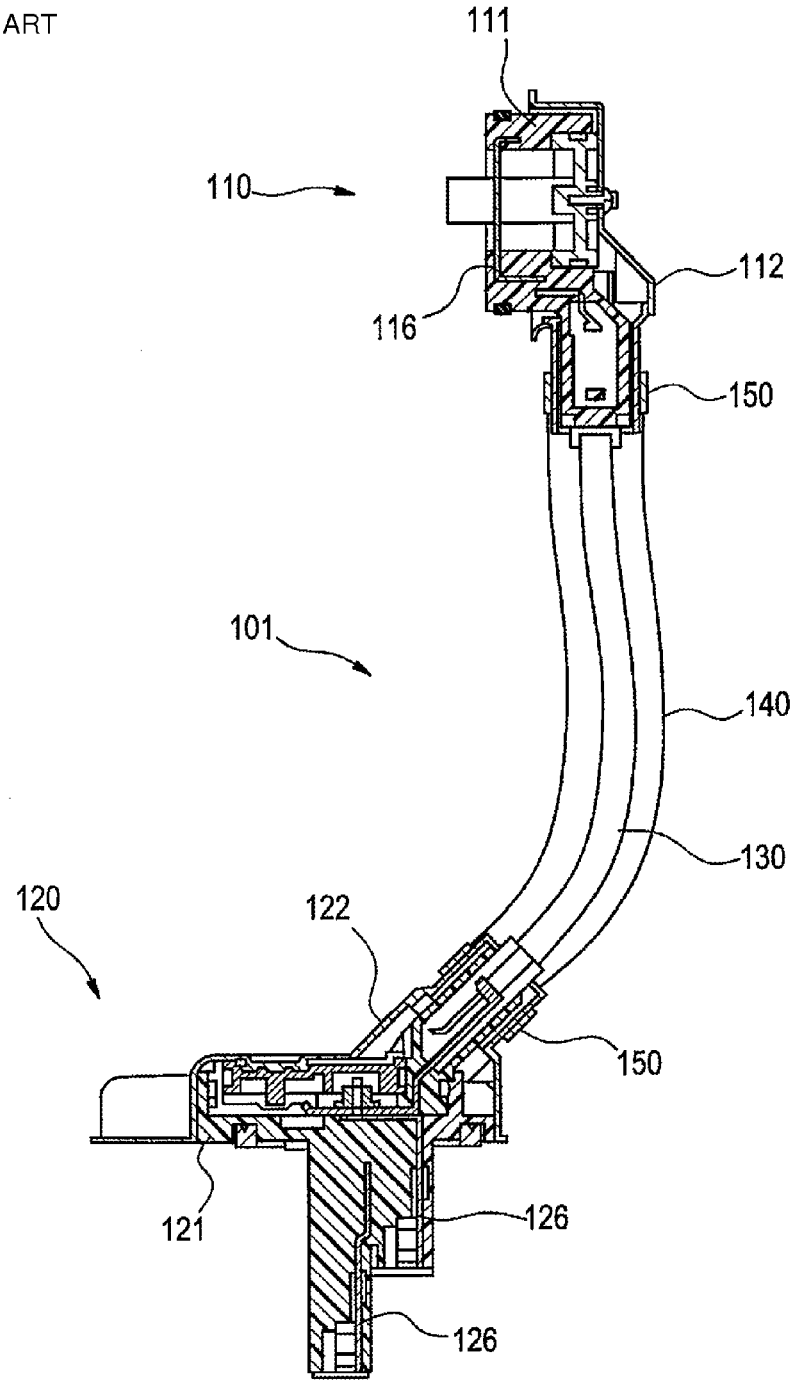
FIG. 8 PRIOR ART
FIG. 8 is a cross-sectional view of the electric wires to which the shield connectors are attached.

FIG. 4 is a perspective view of the external form of a shield connector device of the second embodiment. FIG. 5 is a side view of the shield connector device. FIG. 6A is a cross-sectional view of the vicinity of an upper connector which is part D of FIG. 5. FIG. 6B is a cross-sectional view of the vicinity of a lower connector which is part E of FIG. 5.

In a shield connector device 1A of the second embodiment, the second shield shell 53 is eliminated from the configuration of the first embodiment, and a service cover covering portion 57 formed integrally with the first shield shell 56 compensates for the elimination. Therefore, in the second embodiment, like elements that are the same as those of the first embodiment are denoted by like reference numerals, and descriptions thereof will be omitted or simplified.

In the shield connector device 1A, a shield shell 50A that shields the first connector 10, the second connector 20, and the electric wires 40 are divided into three sections including two first shield shell 55 and 56 fixed to the first connector 10 and the single second shield shell 52 fixed to the second connector 20. In addition, peripheral edges 56*a* (reference numerals of those that are hidden in the figure are omitted) of the shield shells 55, 56, and 52 along the dividing lines overlap each other in a state of enabling relative movement between the first shield shells 55 and 56 and the second shield shell 52.

The one first shield shell 55 in the first shield shells 55 and 56 is configured to cover the outer periphery of the connector housing 11 of the first connector 10 and is fixed to a mating device by the earth terminal 54 of the outer peripheral portion. In addition, the other first shield shell 56 is configured to be joined to the service cover 13 by the screw 61 and thus to be attached to and detached from the connector housing 11 of the first connector 10 concurrently with the attachment and detachment of the service cover 13 to and from the connector housing 11. A part of the other first shield shell 56 that covers the connector housing 11 is configured to come into close contact with and overlap a part of the one first shield shell 55, and is fixed to a mating device by an earth terminal 58 formed in the outer peripheral portion.

In addition, a part of the other first shield shell 56 that covers the electric wires 40 is formed in a half cylinder shape having a small depth and integrally has the service cover covering portion 57 that is bent in an L shape on the tip end side that extends toward the second connector 20 side. The service cover covering portion 57 is formed with such a size that covers the service cover 23 of the second connector 20 and is not fixed to the service cover 23 of the second connector 20.

According to the shield connector device 1A configured as described above, the first and second connectors 10 and 20 at both ends and the electric wires 40 that connect the connectors 10 and 20 at both ends to each other may be reliably shielded by the shield shell 50A.

In addition, although the first shield shells 55 and 56 fixed to the first connector 10 and the second shield shell 52 fixed to the second connector 20 are divided from each other, the peripheral edges along the dividing lines overlap each other. Therefore, shielding characteristics may be ensured without gaps, thereby eliminating shield leakage spots.

In addition, the first shield shells 55 and 56 and the second shield shell 52 are not joined to each other but freely move to some extent relative to each other. Therefore, movability between the connectors 10 and 20 at both ends may be ensured to a necessary extent, and thus there is no inconvenience relating to the slight movement needed to connect the connectors 10 and 20 to the mating connectors.

In addition, since the shield shell 50A may be made of a metal plate, there is no concern of damage even in a collision with other components due to vibration or the like of a device or a vehicle.

In addition, since the connector housings 11 and 21 of the connectors 10 and 20 are respectively provided with the operation opening portions 12 and 22 for connecting the terminals 16 and 26 to the terminals of the mating connectors, the terminals 16 and 26 may be firmly connected to the terminals of the mating connectors through the opening portions 12 and 22, and thus electrical connection performance sufficient to be used for connection to a high-voltage circuit may be realized. In addition, the operation opening portions 12 and 22 formed in the connector housings 11 and 21 may be blocked later by the service covers 13 and 23 and then may be covered with the first shield shells 55 and 56. Therefore, although the connector housings 11 and 21 are provided with the opening portions 12 and 22, reliable sealing characteristics and shielding characteristics may be maintained.

In addition, in the shield connector device 1A of this embodiment, since the service cover 13 of the first connector 10 is provided with the interlocking portion 15, electrical connection to the terminals 16 may be blocked by causing a state in which the service cover 13 of the first connector 10 is detached. Therefore, even in a case of connection to a high-voltage circuit, the connection operation of the terminals 16 may be safely performed. That is, the service cover 23 of the second connector 20 may be detached only when the service cover 13 of the first connector 10 is detached. Therefore, by only providing the interlocking portion 15 to the first connector 10, the service cover 23 of the second connector 20 may be safely detached.

In addition, the first shield shell 56 is joined to the service cover 13 of the first connector 10 and the service cover covering portion 57 is formed integrally with the tip end of the first shield shell 56 joined to the service cover 13 with such a size that covers the service cover 23 of the second connector 20 when the service cover 13 is mounted to the connector housing 11. Therefore, by mounting the service cover 13 of the first connector 10 to the connector housing 11, not only a part including the corresponding service cover 13 but also the service cover 23 of the second connector 20 may be concurrently covered with the shield shell 56.

At this time, since the service cover 23 of the second connector 20 is covered with the first shield shell 56 joined to the service cover 13 of the first connector 10 having the interlocking portion 15, the service cover 23 of the second connector 20 is not detached by the interruption of the service cover covering portion 57 of the first shield shell 56 as long as the service cover 13 on the first connector 10 side provided with the interlocking portion 15 is not detached. Particularly, in the second embodiment, since the service cover 23 of the second connector 20 is covered with the service cover covering portion 57 of the first shield shell 56 joined to the service cover 13 of the first connector 10, the service cover 23 of the second connector 20 may not be detached more reliably as long as the service cover 13 of the first connector 10 is not detached. Therefore, exposure of the terminals 26 due to the service cover 23 of the second connector 20 shifting for some reason may be more reliably prevented, thereby further enhancing safety than the first embodiment.

In addition, the present invention is not limited to the above-described embodiments, and modifications and improvements thereof may be appropriately made. Besides, the material, shape, dimensions, number, arrangement spots, and the like of each element in the above-described embodiments are arbitrary and are not limited as long as the present invention is able to be achieved.

The present application is based on Japanese patent application No. 2011-288960 filed on Dec. 28, 2011, and the contents of the patent application are incorporated herein by reference.

INDUSTRIAL APPLICABILITY

The present invention is useful for providing a shield connector device in which there is no concern of damage even in a case where a shield member that covers the outer side of electric wires impacts with other components due to vibration or the like, while ensuring shielding characteristics and movability between connectors at both ends and not both of a pair of shield connectors needs an interlocking portion.

REFERENCE SIGNS LIST

1 shield connector device
10 first connector
11 connector housing
12 opening portion
13 service cover
15 interlocking portion
16 terminal
20 second connector
21 connector housing
22 opening portion
23 service cover

26 terminal
30 mating connector
36 terminal
40 electric wire
50 shield shell
51 first shield shell
52, 53 second shield shell
51*a*, 52*a*, 53*a* peripheral edge
1A shield connector device
50A shield shell
55, 56 first shield shell
56*a* peripheral edge

The invention claimed is:

1. A shield connector device comprising:

first and second connectors, each of which includes a terminal connected to a terminal of a mating connector, a connector housing made of an insulating material, which accommodates the terminal and is provided with an operation opening portion for connecting the terminal to the terminal of the mating connector, and a service cover made of an insulating material, which is mounted to the connector housing to block the opening portion after a connection operation of the terminal;

an electric wire, both ends of a conductor of which are respectively connected to the terminals of the first and second connectors; and a shield shell made of a metal plate, which shields the first and second connectors and the electric wire, wherein the shield shell is divided into two sections including a first shield shell fixed to the first connector and a second shield shell fixed to the second connector, wherein peripheral edges of the first and second shield shells along a dividing line overlap each other in a state of enabling relative movement between the first shield shell and the second shield shell, wherein the service cover of the first connector is further provided with an interlocking portion which allows electrical connection to the terminal of the first connector when the service cover of the first connector is mounted to the connector housing of the first connector after the terminal of the first connector is connected to the terminal of the mating connector, and blocks electrical connection to the terminal of the first connector when the service cover of the first connector is detached from the connector housing of the first connector, wherein at least a part of the first shield shell is configured to be joined to the service cover of the first connector and thus to be attached to and detached from the connector housing of the first connector concurrently with attachment and detachment of the service cover, wherein at least a part of the second shield shell is configured to be joined to the service cover of the second connector and thus to be attached to and detached from the connector housing of the second connector concurrently with attachment and detachment of the service cover, and wherein a peripheral edge of the at least a part of the first shield shell joined to the service cover of the first connector overlaps an outer side of a peripheral edge of the at least a part of the second shield shell joined to the service cover of the second connector.

2. The shield connector device according to claim 1, wherein at least a part of the first shield shell is configured to be joined to the service cover of the first connector and thus to be attached to and detached from the connector housing of the first connector concurrently with the attachment and the detachment of the service cover, and is formed with such a size that covers the service cover of the second connector when the first shield shell being mounted to the connector housing.

3. The shield connector device according to claim 1, wherein the first shield shell is adapted to interrupt the service cover of the second connector to be detached from the connector housing of the second connector under the condition that the service cover of the first connector is not detached from the connector housing of the first connector.

* * * * *